US008397321B1

(12) United States Patent
Smith

(10) Patent No.: US 8,397,321 B1
(45) Date of Patent: Mar. 19, 2013

(54) WHEEL CHAIR ACCESSIBLE CRIB

(76) Inventor: Brack Smith, Erie, PA (US)

( * ) Notice: Subject to any disclaimer, the term of this patent is extended or adjusted under 35 U.S.C. 154(b) by 0 days.

(21) Appl. No.: 13/417,410

(22) Filed: Mar. 12, 2012

(51) Int. Cl.
*A47D 7/00* (2006.01)

(52) U.S. Cl. ..... 5/100; 5/93.1; 5/424

(58) Field of Classification Search ..... 5/93.1, 5/100, 424–425, 428
See application file for complete search history.

(56) References Cited

U.S. PATENT DOCUMENTS 2,255,160 A * 9/1941 Gordon ..... 472/100
2,555,160 A * 5/1951 Schwarz ..... 5/93.1
6,938,286 B1 * 9/2005 Smith ..... 5/100

* cited by examiner

*Primary Examiner* — Fredrick Conley
(74) *Attorney, Agent, or Firm* — Richard K Thomson

(57) ABSTRACT

A crib has two sets of bi-fold doors which allows access by a wheel-chair-bound care giver and is provided with childproof latches in the form of upper and lower spring-biased actuators which must be simultaneously activated to allow opening of the bi-fold doors. Spring-biased safety bars may additionally be positioned to prevent the bi-fold doors from being opened by an unauthorized person.

7 Claims, 3 Drawing Sheets

WHEEL CHAIR ACCESSIBLE CRIB

BACKGROUND AND SUMMARY OF THE INVENTION

The present invention is directed to the field of child care. More particularly, the present invention is directed to a wheel chair accessible crib with a dual latching mechanism which requires an adult to operate.

The present invention constitutes an improvement of Applicant's earlier U.S. Pat. No. 6,938,286 which is hereby incorporated by reference. Since the issuance of Applicant's earlier patent, drop-side cribs have been legally banned due to the injuries and deaths which have occurred with their use. Applicant's '286 patent remedies the deficiencies of the then existing cribs by providing a pair of bi-fold doors which provide access to the crib and eliminate the potential of injury to the infant. In addition, the height of the crib adjusts to permit the base of a wheel chair and the occupant's lower extremities to slide under the bed placing the baby within the reach of the wheel-chair-bound care giver. The features which have been enhanced in this revised crib include the locking/latching mechanisms. The latch now comprises two spring-biased latches which operate in a vertical plane from above and below each of the bi-fold doors. Two actuator arms must be simultaneously activated to disengage the latches. This adds additional security ensuring that even a toddler will not be capable of opening the doors, thereby putting themselves or an infant sibling at risk. In addition, at least one, preferably two, spring-biased safety bars can be positioned across the doors to prevent them from being opened during low-traffic times such as during sleeping during the night and during extended naps. The spring-biased safety bars can be easily secured and removed by adult care-givers while providing significant impediments to infants, toddlers and young children.

Various other features, advantages, and characteristics of the present invention will become apparent after a reading of the following detailed description.

BRIEF DESCRIPTION OF THE DRAWINGS

The preferred embodiments) of the present invention is/are described in conjunction with the associated drawings in which like features are indicated with like reference numerals and in which.

DETAILED DESCRIPTION OF THE PREFERRED EMBODIMENT(S)

Figure 1:
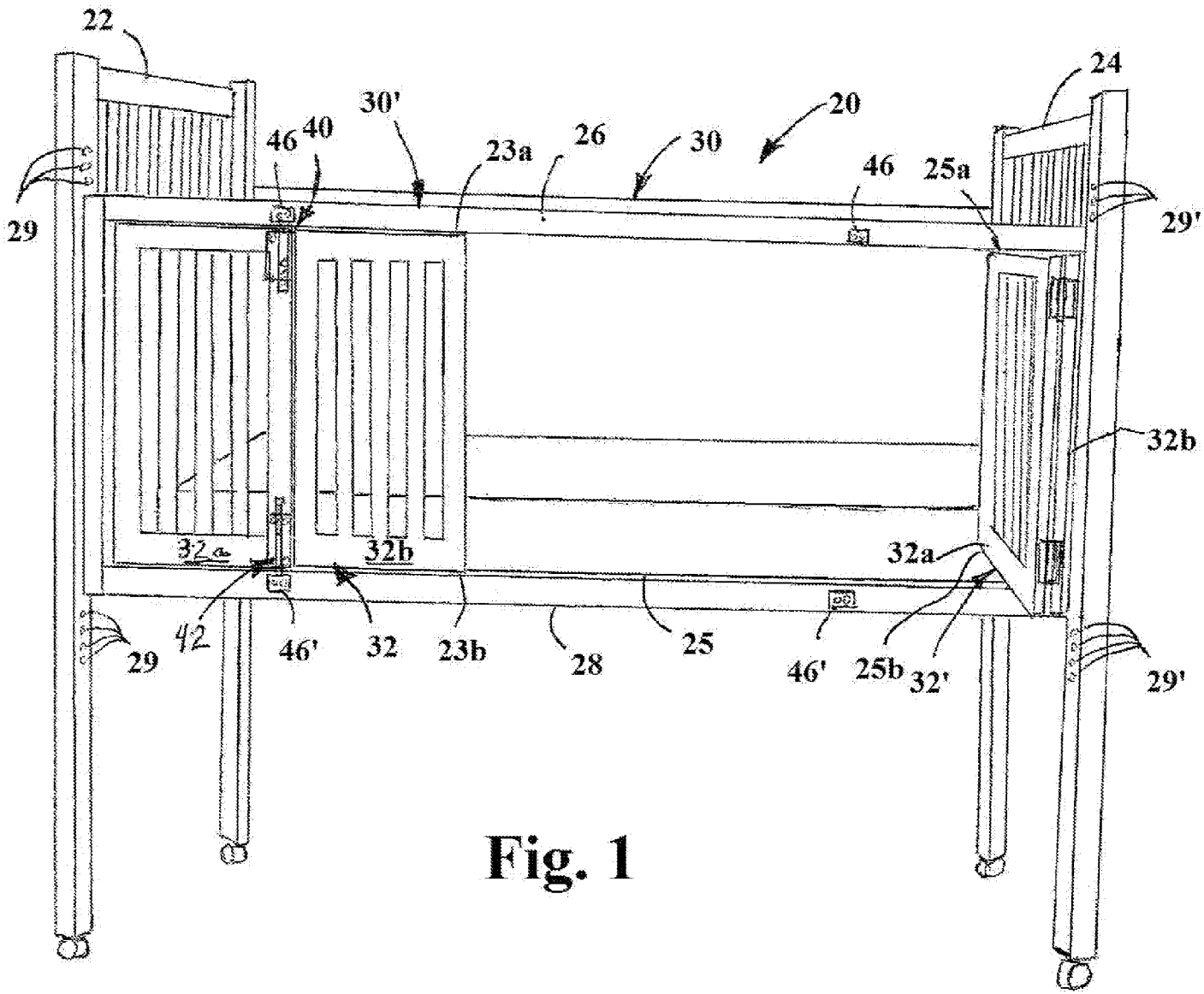
FIG. 1 is a side perspective view of the wheel chair accessible crib of first embodiment of the present invention with the vertical slats of the rearward panel omitted for clarity.

A first embodiment of the wheel chair accessible crib of the present invention is depicted in FIG. 1 generally at 20. First end support 22 is spaced from second end support 24 by a distance that exceeds the normal width of a wheel chair (not shown) and the height of central bed 25 and upper and lower transverse support rails 26, 28 can be adjusted using pins which fit in any of a plurality of holes 29, 29' in first and second end supports 22, 24, respectively, to accommodate the seat of the chair and the lap/legs of the wheel-chair-bound care giver. Crib 20 includes a side frame panel 30 and a second forward side frame panel 30'. Bi-fold doors 32, 32' of the forward panel 30' are each comprised of a first door 32*a* hingedly attached to second door 32*b* and operate in the same manner as those of the '286 patent with pintles (not shown) on the upper and lower corners 23*a*, 23*b* and 25*a*, 25*b*, respectively, riding in channels formed in upper transverse support rail 26 and lower transverse support rail 28.

Figure 2:
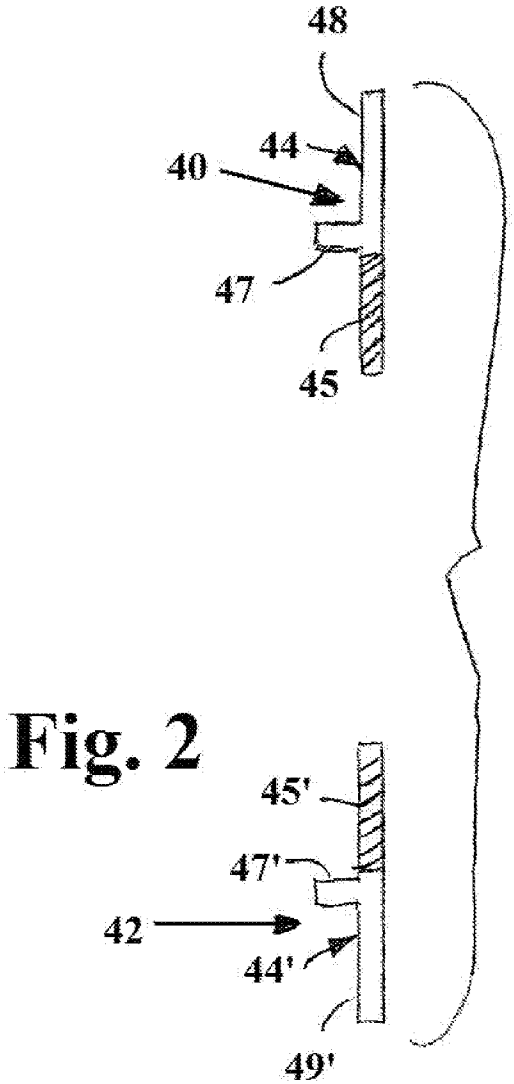
FIG. 2 is an enlarged side view of the latching mechanism of the present invention; and, FIG. 3 is a schematic depiction of the wheel chair accessible crib with safety bars in place.

Among the unique features of this improved crib 20 lies in upper and lower safety latches 40, 42 which secure the doors 32, 32' in a closed position. The latch, as best seen in FIG. 2, comprises a first upper T-shaped latch actuator 44 with a spring 45 for spring-biasing the actuator 44 into keeper 46 mounted on upper transverse support rail 26 and a second lower T-shaped latch actuator 44' with a spring 45' for spring-biasing the actuator 44' into keeper 46' mounted on lower transverse support rail 28. To open the bi-fold door 32, 32', horizontally extending fingers 47, 47' must be simultaneously grasped and pulled downwardly and upwardly (and outwardly to ward the care giver), respectively against the bias of springs 45, 45' to disengage the upper leg 48 and lower leg 49' from keepers 46 and 46', respectively. These actuators 44, 44' must be grasped/moved simultaneously to permit the doors to be opened in order to prevent the crib occupant or an unauthorized older brother or sister from opening the crib since the distance between T-shaped actuators 44, 44' exceeds the reach of most children. This will prevent the occupant from being injured due to exiting of the crib 20 without adult supervision. Most preferably, the latches are at least partially embedded in the wood of the doors with only the fingers 47, 47' protruding. This further ensures that infants and toddlers will be unable to open the actuators 44, 44'.

Figure 3:
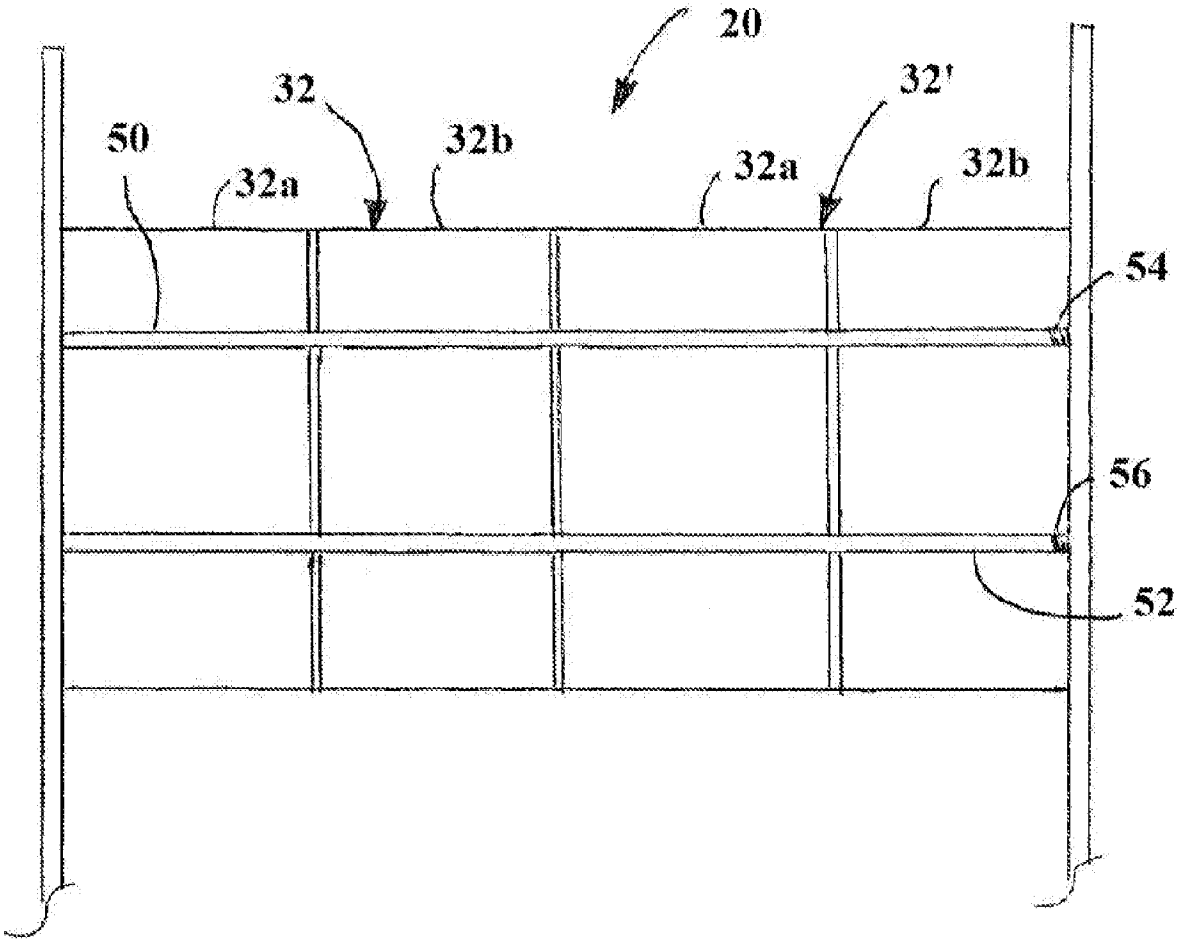

An additional safety feature is depicted in FIG. 3. Two safety bars 50 and 52 can be inserted into recesses provided in the end supports 22, 24. The recess in end support 24 is deeper allowing safety bars 50, 52 to be laterally moved against the bias of springs 54, 56, respectively, and easily removed when not in use. By securing the safety bars across the crib doors 32, 32', even should the occupant or an roving abettor succeed in "jimmying the locks", the safety bars 50, 52 will prevent the bifold doors 32, 32' from opening.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. A wheel chair accessible crib permitting access by a wheel-chair-bound care giver, the wheel chair having a conventional maximum width and seat height, said crib comprising:

a) at least two end supports spaced by a distance greater than the maximum width of the wheel chair;

b) a central bed extending between said at least two end supports, said central bed portion having a lowermost extent which exceeds the seat height of the wheel chair by an amount sufficient to accommodate a lap of the care giver;

c) two side frame members for restraining an infant;

d) at least one of said side frame members having a two sets of bi-fold access doors which open and close between a first upper transverse support rail and a second lower transverse support, each set including a first door hingedly attached to a second door, said two sets of bi-fold access doors pivotally retracting out of the way in opposite lateral directions in a manner to permit said wheel-chair-bound care giver to access the infant without interfering with the approach of the wheel chair;

e) upper and lower latch means on at least one of said first and second doors of each set of said bi-fold access doors for securing said bi-fold doors in a closed position, said upper and lower latch means requiring simultaneous operation to permit said set of bi-fold access doors to be pivoted from a first closed latched position to a second open access position, said upper and lower latch means comprising a T-shaped latch actuator which is spring-biased into an engaged position.

2. The wheel chair accessible crib of claim 1 further comprising at least one safety bar positionable across said bi-fold access doors to prevent said doors from pivoting to said second open position.

3. The wheel chair accessible crib of claim 1 wherein each of said upper latch means includes a first keeper secured to said first upper transverse support, said first keeper receiving said spring-biased latch actuator of said upper latch means.

4. The wheel chair accessible crib of claim 1 wherein each of said lower latch means includes a second keeper secured to said second lower transverse support, said second keeper receiving said spring-biased latch actuator of said lower latch means.

5. A wheel chair accessible crib permitting access by a wheel-chair-bound care giver, the wheel chair having a conventional maximum width and seat height, said crib comprising:

a) at least two end supports spaced by a distance greater than the maximum width of the wheel chair;

b) a central bed extending between said at least two end supports, said central bed portion having a lowermost extent which exceeds the seat height of the wheel chair by an amount sufficient to accommodate a lap of the care giver;

c) two side frame members for restraining an infant;

d) at least one of said side frame members having a two sets of bi-fold access doors which open and close between a first upper transverse support rail and a second lower transverse support, each set including a first door hingedly attached to a second door, said two sets of bi-fold access doors pivotally retracting out of the way in opposite lateral directions in a manner to permit said wheel-chair-bound care giver to access the infant without interfering with the approach of the wheel chair;

e) latch means on at least one of said first and second doors of each set of said bi-fold access doors for securing said bi-fold doors in a closed position;

f) at least one safety bar positionable across said bi-fold access doors preventing said access doors from pivoting open.

6. The wheel chair accessible crib of claim 5 wherein said latch means comprises upper and lower latch means for each pair of bi-fold access doors, said upper and lower latch means requiring simultaneous operation to permit said set of bi-fold access doors to be pivoted from a first closed latched position to a second open access position.

7. The wheel chair accessible crib of claim 5 wherein said at least one safety bar comprises two safety bars positionable across a top portion of said doors and a bottom portion of said doors.

* * * * *